US006145811A

United States Patent [19]

Cheldin

[11] Patent Number: 6,145,811

[45] Date of Patent: Nov. 14, 2000

[54] STAPLE REMOVER HAVING PLANAR PRESSING SURFACES AND STAPLE RECEIVING LOCKING NOTCHES

[75] Inventor: Erwin Cheldin, Woodland Hills, Calif.

[73] Assignee: Erkie, Inc., Woodland Hills, Calif.

[21] Appl. No.: 09/386,129

[22] Filed: Aug. 30, 1999

Related U.S. Application Data

[63] Continuation-in-part of application No. 09/347,832, Jul. 2, 1999, abandoned.

[60] Provisional application No. 60/127,190, Mar. 31, 1999.

[51] Int. Cl.[7] ..... B25C 11/00

[52] U.S. Cl. ..... 254/28

[58] Field of Search ..... 254/28, 18; 7/125, 7/165, 166

[56] References Cited

U.S. PATENT DOCUMENTS

| | | | |
|---|---|---|---|
| D. 352,217 | 11/1994 | Hochfeld et al. . | |
| 858,257 | 6/1907 | Breiding | 254/28 |
| 2,356,693 | 8/1944 | Polzer . | |
| 2,400,988 | 5/1946 | Goessel . | |
| 3,143,800 | 8/1964 | Vizzi . | |
| 3,311,346 | 3/1967 | Almond . | |
| 3,494,591 | 2/1970 | Fleming . | |
| 3,630,486 | 12/1971 | Foitle . | |
| 3,761,057 | 9/1973 | Nembhard et al. . | |
| 4,028,758 | 6/1977 | O'Connor . | |
| 4,670,926 | 6/1987 | Bruno . | |
| 4,784,370 | 11/1988 | Strickland . | |
| 4,869,464 | 9/1989 | Davidson | 254/28 |
| 4,921,216 | 5/1990 | Krulich . | |
| 5,085,404 | 2/1992 | Thieleke et al. . | |
| 5,090,662 | 2/1992 | Koo . | |
| 5,292,106 | 3/1994 | Li . | |
| 5,354,033 | 10/1994 | Cheldin . | |
| 5,513,833 | 5/1996 | Kirk . | |
| 5,875,503 | 3/1999 | Cheldin . | |
| 5,918,859 | 7/1999 | Qian . | |
| 5,938,178 | 8/1999 | Oh | 254/28 |

FOREIGN PATENT DOCUMENTS

| | | | |
|---|---|---|---|
| 4-183579 | 6/1992 | Japan | 254/28 |

*Primary Examiner*—Robert C. Watson
*Attorney, Agent, or Firm*—Kelly Bauersfeld Lowry & Kelley, LLP

[57] ABSTRACT

An apparatus for removing staples including first and second jaws pivotally connected at their first ends, and first and second wedging elements connected to second ends of the jaws. First and second platforms are attached to the respective first and second jaws. Each platform has a planar pressing surface and a planar pressing stub extending laterally from opposing sides of the platform, such that the planar surfaces and the stubs of the first and second platforms generally face one another. The jaws include notches formed on an inner edges thereof for the grasping of staples. The apparatus further includes first and second gripping elements attached to and extending laterally from the first and second jaws so as to face one another for the removal of difficult-to-remove staples.

10 Claims, 1 Drawing Sheet

STAPLE REMOVER HAVING PLANAR PRESSING SURFACES AND STAPLE RECEIVING LOCKING NOTCHES

RELATED APPLICATION

This application is a continuation-in-part of U.S. patent application Ser. No. 09/347,832, filed Jul. 2, 1999, now abandoned, which claims priority from provisional application Ser. No. 60/127,190 filed Mar. 31, 1999.

BACKGROUND OF THE INVENTION

The invention relates to staple removers; and, more particularly, to double jawed staple removers having planar pressing surfaces and staple locking notches.

A wide variety of modern-day businesses utilize staple removers on a daily basis to effect disengagement of staples from stapled articles. Staple removers are also commonly used within the personal residence of the typical consumer. Of the commercially available hand-held staple removers utilized in both business and consumer applications, one of the most common types is the double-jawed staple remover.

The typical double-jawed staple remover is provided with first and second jaws which are pivotally connected for rotation towards one another about a single axis. The first jaw has a first pair of spaced apart walls which move in a plane which is perpendicular to the axis of rotation and which have wedging elements for engaging a staple. The second jaw has a second pair of spaced apart walls which also move in a plane which is perpendicular to the axis of rotation and which also have wedging elements for engaging a staple. The distance between the second pair of walls relative to the first pair of walls is such that, upon rotation of the first and second jaws towards one another into a closed position, the second pair of walls are positioned between the overlap with the first pair of walls.

The first and second jaws of these staple removers are typically provided with finger-receiving ears which are positioned on the outside of the first and second jaws, respectively, substantially adjacent the wedging elements of the first and second pairs of walls. Typically, the pressing surfaces are somewhat angled and indented. This design is intended to fit the thumb and fingers of the user.

To effect removal of a staple from a stapled article, the operator forcibly rotates the first and second jaws towards one another into overlapping positions, usually by applying a thumb to one pressing surface and one or more fingers to the other pressing surface, simultaneously driving the wedging elements of the first and second pair of walls between the staple and the stapled article and thereafter pulling or twisting the double-jawed staple remover so as to disengage the staple from the stapled article. Some staple removers include notches formed within the wedging elements of the upper first jaws in order to more fully grip the staple during removal.

In my U.S. Pat. No. 5,354,033, I addressed the problem where, in heavy duty applications, the operator must often apply substantial forces to the pressing surfaces and may succeed only in partially disengaging the staple from the stapled article. In the course of squeezing, pulling and/or twisting the staple, it is also common for the staple to shear so as to leave a portion of the staple within the stapled article with an exposed tip extending therefrom. Accordingly, the operator of these double-jawed staple removers must locate a pair of pliers or other suitable means for gripping and separating the partially disengaged or sheared staple from the stapled article. This is highly inefficient and results in the loss of valuable time. I thus disclosed in my prior patent a double-jawed staple-remover having a pair of grippers for removing partially disengaged or sheared staples from a stapled article.

I have found that the angled or elevated pressing surfaces generally do not fit the thumb and fingers of the user, causing a nonuniformity of pressure to be applied to the jaws of the staple remover and resulting in uncomfortable pressure points in the fingers and thumb. By flattening the pressing surfaces, the pressure applied is uniform and the staple remover is more comfortable to the user's fingers and thumb. I have also found that increased grip of the staple during removal is achieved by adding staple locking notches in both the first and second jaws. Therefore, what is needed is a double-jawed staple remover having horizontally flat planar pressing surfaces, staple locking notches and gripping elements. The finger pressing surfaces on the side of the gripping elements should be unobtrusive to the function of the gripping elements. The present invention fulfills these needs and provides other related advantages.

SUMMARY OF THE INVENTION

The present invention resides in an apparatus for removing staples comprising, generally, first and second jaws pivotally connected at first ends, a first wedging element connected to a second end of the first jaw, a second wedging element connected to a second end of the second jaw, a first platform attached to the first jaw and having a planar pressing surface and a planar pressing stub extending laterally from opposing sides of the platform, a second platform attached to the second jaw and also having a planar pressing surface and a planar pressing stub extending laterally from opposing sides of the platform such that the planar surfaces and the stubs of the first and second platforms generally face one another.

The apparatus includes biasing means in the form of a spring positioned between the first ends of the jaws for biasing the second ends of the jaws apart from one another.

The apparatus also includes staple locking notches formed on inner edges of the first and second wedging elements such that during closure of the first and second jaws the notches of the first and second wedging elements substantially align with one another to grasp the staple.

The apparatus further includes first and second gripping elements which extend laterally from the first and second jaws, respectively so as to generally face one another. Preferably, the gripping elements extend on the same side of the apparatus as the planar pressing stubs. The first and second gripping elements are configured such that when the jaws are pivotally closed, an outer portion of each of the first and second gripping elements come into contact with one another, while an inner portion of the gripping elements remain spaced apart from one another in order to grip staples of various widths.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
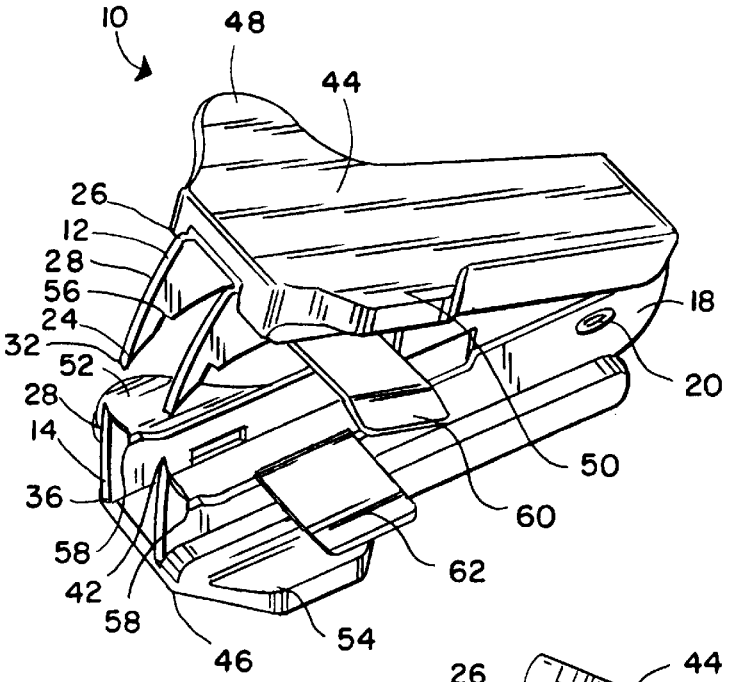
FIG. 1 is a perspective view of a double-jawed staple remover having planar pressing surfaces, staple locking notches and gripping elements.
Figure 2:
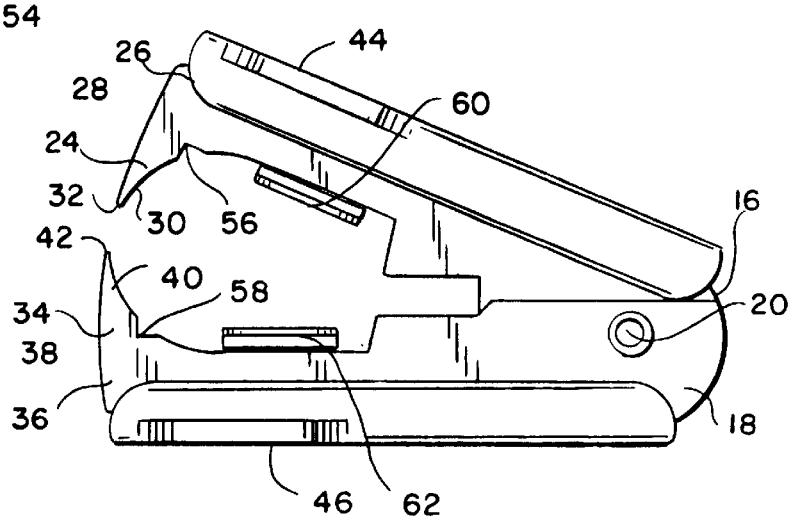
FIG. 2 is a side elevational view of the double-jawed staple remover of FIG. 1.
Figure 3:
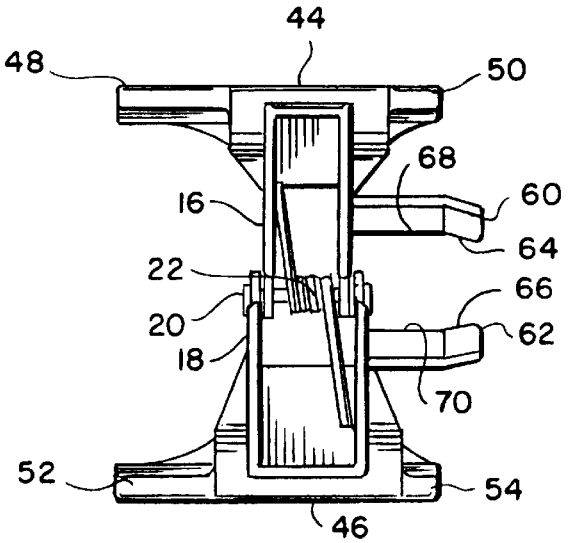
FIG. 3 is a rear elevational view of the double-jawed staple remover of FIG. 1, illustrating the pressing surfaces in a flat horizontal plane.

An improved double-jawed staple remover having planar pressing surfaces, generally referred to by the reference number 10, is shown in FIG. 1. The staple remover 10 is provided with first and second jaws 12 and 14 which are pivotally connected at ends 16 and 18 about pin 20 for rotation towards one another about the pin 20. A spring 22, as illustrated in FIG. 3, is provided to bias jaws 12 and 14 away from one another into an open position which is at least as great as the width of a staple, as shown in FIGS. 1 and 2.

The first jaw 12 has wedging elements 24 reaching downwardly at the second end 26 of the first jaw 12. The wedging elements 24 have an outer edge 28 and an arcuate inner edge 30 which meet at a point 32. Likewise, the second jaw 14 has a pair of wedging elements 34 reaching upwardly from the second end 36 of the second jaw 14. The wedging elements 34 also have an outer edge 38 and an arcuate inner edge 40 meeting at a point 42. The distance between the wedging elements 24 of the first jaw 12 relative to the pair of wedging elements 34 of the second jaw 14 is preferably such that, upon rotation of the first and second jaws 12 and 14 towards one another, the wedging elements 24 and 34 overlap and slidably engage one another in the closed position (not shown).

A first platform 44 is provided on the first jaw 12 to facilitate manual rotation of the first jaw 12 into slidable engagement with the second jaw 14. Similarly, a second platform 44 is provided on the second jaw 14 to facilitate manual rotation of the second jaw 14 into slidable engagement with the first jaw 12. The first platform 44 includes a flattened planar pressing surface 48 extending away from the first jaw 12 and a planar pressing stub 50 extending a shortened distance from the first jaw 12 in the opposite direction. Similarly, the second platform 46 includes a planar pressing surface 52 extending from the second jaw 14 and in the same direction as the planar pressing surface of the first platform 36 as well as a planar pressing stub 54 extending from the second jaw 14 opposite the planar pressing surface 52. The planar pressing surfaces 48 and 52 and the planar pressing stubs 50 and 54 are flattened to the respective plane of the first and second platform 44 and 46.

As described in International Publication Number WO 99/08842, the contents of which are incorporated by reference herein, notches 56 and 58 are formed on the respective inner edges 30 and 40 of both jaws 12 and 14. The notches 56 and 58 are positioned on the inner edges 30 and 40 so that the notches 56 of the first jaw 12 substantially align with the notches 58 of the second jaw 14 at some point during closure of the staple remover 10. The notches 56 and 58 cooperate to grasp the staple as it is being removed from the stapled article. The notches 56 and 58 may be smooth, angled or irregularly shaped to enhance the grasp of the staple. The notches 56 and 58 are preferably of a depth within the inner edges 30 and 40 approximating the width of a staple wire so as to firmly grasp the staple.

In operation, a staple is removed by pressing the first and second platforms 44 and 46 together, causing the points of the first and second jaws 32 and 42 to move under the staple. As the platforms 44 and 46 are increasingly pressed together, the first and second jaws 16 and 18 begin to overlap. The staple is lifted from the article and partially removed by its contact with the arcuate inner edges 30 and 40 of the jaws 16 and 18. At some point during the closure of the staple remover 10, preferably near or at full closure, the staple is grasped by the notches 56 and 58. The staple is caught firmly within the notches 56 and 58 and the staple remover 10 is lifted from the article to fully release the staple. The cooperation of the notches 56 and 58 in firmly grasping the staple during removal results in fewer incidents of partial staple disengagement than with staple removers having only one set of notches or no notches at all.

As best shown in FIG. 1, the first and second jaws 12 and 14 are also provided with an opposing pair of gripping elements 60 and 62 which cooperate to engage and detach difficult-to-remove staples which are partially disengaged from stapled articles. The gripping elements 60 and 62 are positioned on the side of the staple remover 10 which has the shortened stubs 50 and 54 to facilitate staple removal. The surfaces of the gripping elements 60 and 62 are configured such that when the first and second jaws 12 and 14 are pivotally closed, an outer portion 64 and 66 of each of the first and second gripping elements 60 and 62 come into contact with one another, while an inner portion 68 and 70 of the first and second gripping elements 60 and 62 remain spaced apart from one another. The spacing between the inner portions 68 and 70 facilitates the gripping and removal of larger objects.

When it is necessary to remove a partially disengaged staple or a sheared staple from a stapled article, the user needs only to rotate the improved staple remover 10 within his or her hand from the normal position of use and then, using a thumb applied to one planar pressing surface and one or more fingers applied to the other planar pressing surface, squeezing the first platform and second platforms 44 and 46 until the first and second gripping elements 60 and 62 engage one another about the staple and thereafter pulling or twisting the staple remover 10 so as to completely disengage the partially disengaged or sheared staple from the stapled article. Preferably, the gripping surfaces of the gripping elements 60 and 62 are provided with discontinuities to improve the gripping characteristics thereof. Although the gripping elements 60 and 62 are preferably aligned with the planar pressing surface stubs 50 and 54 so as not to be impeded in their use, the gripping elements 60 and 62 may be positioned anywhere on the first and second jaws 12 and 14, respectively, so long as the gripping elements 60 and 62 cooperate to grasp a partially disengaged or sheared staple.

The first and second jaws 12 and 14 may be comprised of any deformation resistant or otherwise resilient material, but are typically comprised of metal. Preferably the jaws 12 and 14 are comprised of a rigid durable oxidation-resistant metal such as stainless steel. The gripping elements 60 and 62 are typically integrally formed with the jaws 12 and 14 and comprised of the same material as the jaws 12 and 14.

Although platforms 44 and 46 may also be integrally formed with the first and second jaws 12 and 14, it is preferred that the platforms 44 and 46 be composed of a hard plastic or other low cost material suitable for the application. By flattening the pressing surfaces 48 and 52 and shortened pressing surface stubs 50 and 54 of the staple remover 10 the otherwise uneven pressure points are eliminated, resulting in uniform pressure being applied to the planar pressing surfaces of the staple remover 10 and more comfort to the user's fingers and thumb. The uniformity of pressure may also result in less overall force necessary to remove the staple.

Although the above embodiment has been described in detail for purposes of illustration, various modifications may be made without departing from the scope and spirit of the invention. Accordingly, the invention is not to be limited, except as by the appended claims.

What is claimed is:

1. An apparatus for removing staples, comprising:

first and second jaws pivotally connected at first ends thereof;

a first wedging element connected to a second end of the first jaw;

a second wedging element connected to a second end of the second jaw;

a first platform attached to the first jaw and having a planar pressing surface extending laterally from the first platform and a planar pressing stub extending laterally from an opposing side of the platform adjacent the second end of the first jaw;

a second platform attached to the second jaw and having a planar pressing surface extending laterally from the second platform and a planar pressing stub extending laterally from an opposing side of the platform adjacent the second end of the second jaw, such that the planar pressing surfaces and the stubs of the first and second platforms are generally facing one another; and a first gripping element attached to and extending laterally from the first jaw and a second gripping element attached to and extending laterally from the second jaw such that the first and second gripping elements generally face one another;

wherein the first and second gripping elements are configured such that when the first and second jaws are pivotally closed, an outer portion of each of the first and second gripping elements come into contact with one another while an inner portion of the gripping elements remain spaced apart from one another.

2. The apparatus of claim 1, including means for biasing the second ends of the first and second jaws apart from one another.

3. The apparatus of claim 2, wherein the biasing means comprises a spring positioned between the first ends of the first and second jaws.

4. The apparatus of claim 1, wherein the first and second gripping elements and the planar pressing stubs of the first and second jaws extend laterally from one side of the apparatus.

5. The apparatus of claim 1, including notches formed on inner edges of the first and second wedging elements such that when the first and second jaws are pivotally closing the notches of the first and second wedging elements substantially align with one another.

6. An apparatus for removing staples, comprising:

first and second jaws pivotally connected at first ends thereof;

means for biasing the second ends of the first and second jaws apart from one another;

a first wedging element connected to a second end of the first jaw and having notches formed on inner edges thereof;

a second wedging element connected to a second end of the second jaw and having notches formed on inner edges thereof such that when the first and second jaws are pivotally closing the notches of the first and second wedging elements substantially align with one another;

a first platform attached to the first jaw and having a planar pressing surface extending laterally from the first platform and a planar pressing stub extending laterally from an opposing side of the platform adjacent the second end of the first jaw;

a second platform attached to the second jaw and having a planar pressing surface extending laterally from the second platform and a planar pressing stub extending laterally from an opposing side of the platform adjacent the second end of the second jaw, such that the planar pressing surfaces of the first and second platforms are generally facing one another; and a first gripping element attached to and extending laterally from the first jaw, and a second gripping element attached to and extending laterally from the second jaw such that the first and second gripping elements generally face one another;

wherein the first and second gripping elements are configured such that when the first and second jaws are pivotally closed, an outer portion of each of the first and second gripping elements come into contact with one another while an inner portion of the gripping elements remain spaced apart from one another.

7. The apparatus of claim 6, wherein the first and second gripping elements and the planar pressing stubs of the first and second jaws extend laterally from one side of the apparatus.

8. The apparatus of claim 6, wherein the biasing means comprises a spring positioned between the first ends of the first and second jaws.

9. An apparatus for removing staples, comprising:

first and second jaws pivotally connected at first ends thereof;

means for biasing the second ends of the first and second jaws apart from one another;

a first wedging element connected to a second end of the first jaw and having inner edges with notches formed therein;

a second wedging element connected to a second end of the second jaw and having inner edges with notches formed therein;

a first platform attached to the first jaw and having a planar pressing surface extending laterally from the first platform and a planar pressing stub extending laterally from an opposing side of the platform adjacent the second end of the first jaw; and a second platform attached to the second jaw and having a planar pressing surface extending laterally from the second platform and a planar pressing stub extending laterally from an opposing side of the platform adjacent the second end of the second jaw, such that the planar pressing surfaces of the first and second platforms are generally facing one another;

a first gripping element attached to and extending laterally from the first jaw; and a second gripping element attached to and extending laterally from the second jaw such that the first and second gripping elements generally face one another;

wherein the notches of the first and second wedging elements are placed so as to substantially align with one another when the first and second jaws are pivotally closing;

wherein the first and second gripping elements are configured such that when the first and second jaws are pivotally closed, an outer portion of each of the first and second gripping elements come into contact with one another while an inner portion of the gripping elements remain spaced apart from one another; and wherein the first and second gripping elements and the planar pressing stubs of the first and second jaws extend laterally from one side of the apparatus.

10. The apparatus of claim 9, wherein the biasing means comprises a spring positioned between the first ends of the first and second jaws.

* * * * *